US009666920B2

(12) United States Patent
Denis et al.

(10) Patent No.: US 9,666,920 B2
(45) Date of Patent: May 30, 2017

(54) DEVICE FOR TRANSMITTING ENERGY ACROSS A SEPARATING WALL, WHERE THE WALL INCLUDES A CONDUCTIVE ELEMENT WITH A HOLE THEREIN WHICH PASSES THROUGH THE WALL

(71) Applicant: THALES, Courbevoie (FR)

(72) Inventors: Philippe Hervé Denis, Choisy le Roi (FR); Jean-François Jarno, Suresnes (FR); Jean-Claude Racamier, Meudon la Foret (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 14/731,690

(22) Filed: Jun. 5, 2015

(65) Prior Publication Data

US 2015/0357694 A1 Dec. 10, 2015

(30) Foreign Application Priority Data

Jun. 6, 2014 (FR) ..... 14 01301

(51) Int. Cl.
*H01P 1/08* (2006.01)
*H01P 1/04* (2006.01)

(52) U.S. Cl.
CPC ..... *H01P 1/08* (2013.01); *H01P 1/045* (2013.01)

(58) Field of Classification Search
CPC ..... H01P 1/042; H01P 1/045; H01P 1/08
USPC ..... 333/254, 252, 260
See application file for complete search history.

(56) References Cited

U.S. PATENT DOCUMENTS 3,058,074 A 10/1962 Kane
3,172,944 A 3/1965 Hynes et al.
3,943,470 A * 3/1976 Bingham ..... H01R 9/0521 333/260
4,543,548 A 9/1985 Seal et al.
4,757,292 A * 7/1988 Basil, Jr. et al. ..... H01P 1/08 228/124.1
2006/0199432 A1 9/2006 Taylor

* cited by examiner

*Primary Examiner* — Benny Lee
(74) *Attorney, Agent, or Firm* — Baker Hostetler LLP

(57) ABSTRACT

A device for transmitting energy comprises: a wall separating two media; and at least one conductive element passing through the wall, the conductive element comprising an energetically conductive material extending in a longitudinal direction. The conductive element is joined to the wall and comprises a hole passing through the wall and extending in a direction substantially parallel to the longitudinal direction on either side of the surfaces of the wall, over respective lengths that are larger than or equal to the largest dimension of a cross section of the conductive element considered level with the wall, the maximum ratio of the area of the cross section of the conductive element with the hole to the area of the cross section of the conductive element without the hole level with the wall being higher than or equal to a threshold comprised between 0.85 and 0.95.

8 Claims, 2 Drawing Sheets

DEVICE FOR TRANSMITTING ENERGY ACROSS A SEPARATING WALL, WHERE THE WALL INCLUDES A CONDUCTIVE ELEMENT WITH A HOLE THEREIN WHICH PASSES THROUGH THE WALL

CROSS-REFERENCE TO RELATED APPLICATION

This application claims priority to foreign French patent application No. FR 1401301, filed on Jun. 6, 2014, the disclosure of which is incorporated by reference in its entirety.

FIELD OF THE INVENTION

The invention relates to a device allowing energy to be transmitted from one medium to another.

More precisely, the invention relates to a device, such as a microwave window, for example, allowing energy to pass. The device may notably be used at the exit of a power electron tube to transmit a microwave-frequency electromagnetic wave between the interior of a tube, for example, under vacuum, and the exterior of the tube at atmospheric pressure. The tube may be an amplifier, for example, a travelling wave tube.

BACKGROUND

FIG. 1 is a conventional representation of a microwave window. The microwave window 1 comprises a wall 2 and typically the wall 2 comprises a ceramic material such as alumina.

The microwave window 1 furthermore comprises a core 3 passing through the wall 2, the core 3 extending in a longitudinal direction $d_{Long}$.

A cladding 4 comprising a material ensuring thermomechanical and microwave matching is arranged coaxially around the wall 2.

A body 5 made of a metal, stainless steel for example, allows a coupled assembly to be created that can be assembled with an electron tube.

All of these parts are assembled by brazing, the core 3 being sufficiently small in size that expansion differences between these parts allow a satisfactory mechanical strength to be guaranteed. Typically, the diameter d1 of the core 3 is about 0.5 mm.

This first solution of FIG. 1 is complex to implement and it requires a plurality of assembly and brazing steps.

Another solution consists in using a core 3 comprising controlled expansion materials.

The low thermal expansion materials generally used are FENICO™ provided by Fenico Precision Castings of CA (or other types of expansion materials) having a low thermal elongation coefficient of about 0.0121 mm per mm at 1010° C., or molybdenum having an elongation coefficient of about 0.0057 mm per mm at 1010° C.

One drawback of microwave windows using controlled expansion materials is that these materials are highly resistive, thereby limiting power transmission capability.

Another possible solution consists in using a material such as moly-copper associating the low thermal expansion properties of molybdenum and the good energy conduction properties of copper.

SUMMARY OF THE INVENTION

One aim of the invention includes providing an alternative device for transferring energy from one medium to another, whether hermetically or otherwise.

According to one aspect of the invention, a device for transmitting energy is provided, comprising:

a wall separating two media; and at least one conductive element passing through the wall, the conductive element comprising an energetically conductive material extending in a longitudinal direction, the conductive element being joined to the wall and furthermore comprising a hole passing through the wall and extending in a direction substantially parallel to the longitudinal direction on either side of the surfaces of the wall over respective lengths that are larger than or equal to the largest dimension of a cross section of the conductive element, the cross section of the conductive element being considered level with the wall, and the ratio of the area of the cross section of the conductive element with the hole to the area of the cross section of the conductive element without the hole, the cross sections St and Sc being considered level or flush with the wall, being higher than or equal to a threshold comprised between 0.85 and 0.95. Advantageously, the threshold is higher than 0.9.

The invention allows highly energetically conductive materials such as copper, gold or silver to be assembled with thin dielectrics or thermal insulators such as alumina, for example.

This embodiment obtains a good compromise between the capacity of the conductive element to relieve mechanical stresses and a high level of power transfer.

Advantageously, the cross section of the conductive element in the thickness of the wall is circular and constant, thereby facilitating implementation. The cross section of the conductive element has a first diameter smaller than or equal to 3 mm.

When the invention is applied to microwave tube coaxial exit windows with such a dimension smaller than or equal to 3 mm (by way of example of such tubes, mention may be made of TWTs) output powers may be obtained in the 100-300 W range because power transmission through the window remains high (relative to this small cross section of 3 mm diameter) because the hollowed out portion of the window has a small cross section (10% of the cross section of a "solid" window).

Advantageously, the cross section of the hole is circular and constant.

Advantageously, the thickness of the wall in the longitudinal direction is smaller than or equal to 1 mm depending on the flexibility required to accommodate for the various thermomechanical stresses created during the various assembly phases and during stresses due to the transfer of electrical or microwave energy.

Advantageously, the device for transmitting energy such as described above is a microwave window.

According to another aspect of the invention, a device such as described above is provided comprising a plurality of conductive elements arranged substantially parallel to the longitudinal direction, the distance between two successive conductive elements being larger than or equal to 0.5 mm.

BRIEF DESCRIPTION OF THE DRAWINGS

The invention will be better understood and other advantages will become apparent on reading the following non-limiting description, and by virtue of the appended figures, in which.

DETAILED DESCRIPTION

Figure 1:
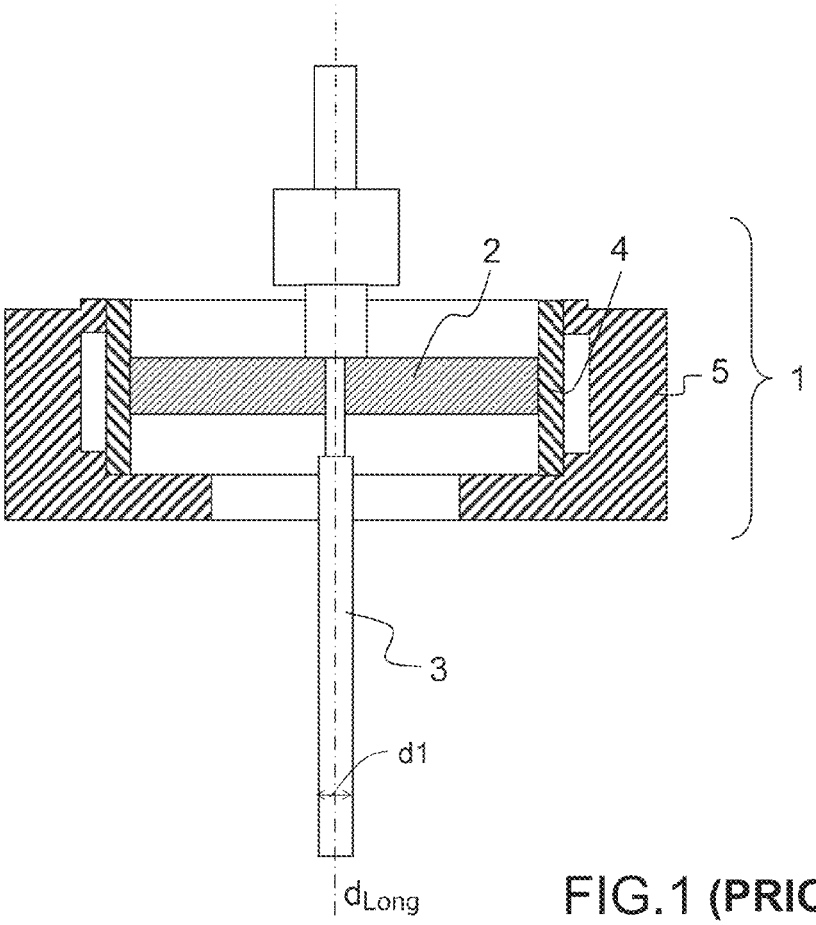
FIG.1 (PRIOR ART)
FIG. 1, described above, shows a first microwave window according to the prior art.
Figure 2:
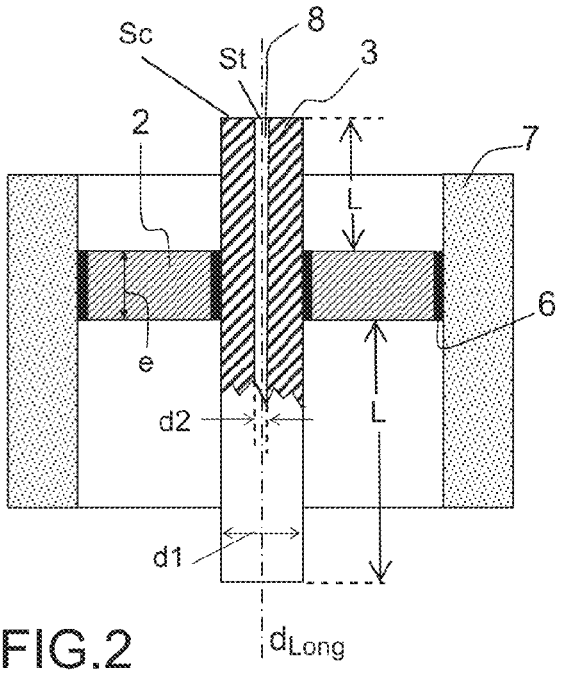
FIG. 2 shows a device for transmitting energy from one medium to another, according to one aspect of the invention.

One embodiment of the invention is shown in FIG. 2.

In the case in point, the device comprises a wall 2 comprising an electrically and thermally insulating material such as a ceramic, alumina being very particularly suitable. The wall 2 is joined to connector parts 7, for example using brazed joints 6.

The transmitting device according to one aspect of the invention allows a conductive element 3 to be assembled with a thermally and/or electrically insulating wall 2.

The wall 2 may be of any thickness e. However, the device described is particularly applicable to devices notably having a small wall 2 of thickness e, typically smaller than about 1 mm.

This is because mechanical stresses due to temperature variations are, for this type of device, correspondingly more critical to the integrity of the energy transmitting device.

The conductive element 3 extends in a longitudinal direction $d_{Long}$ and passes through the wall 2.

The conductive element 3 comprises a material having good energy conduction properties, such as copper. The transmitted energy will possibly take the form of thermal energy, an electrical current or electromagnetic waves.

Figure 4:
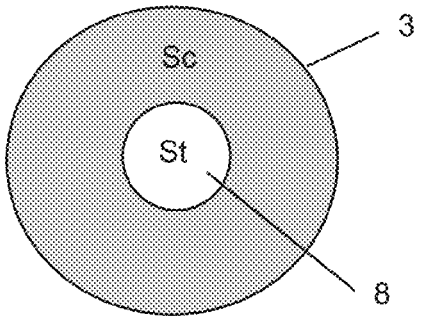
FIG. 4 illustrates the cross section (Sc) of the conductive element and the cross section (St) of a hole in the conductive element, according to an aspect of the invention.

The cross section Sc of the conductive element 3, shown in FIG. 4, considered level with the wall 2 may be of any size; the cross section Sc of the conductive element 3 is preferably circular and constant in the thickness e of the wall 2 and has a first diameter d1.

The conductive element 3 is joined to the wall 2, for example hermetically, depending on the applications for which the energy transmitting device is intended. The conductive element 3 may, for example, be joined to the wall 2 by means of an adhesive, brazed joints or welded joints. In the case in point, the joint of the conductive element 3 to the wall 2 is achieved using brazed joints 6.

The conductive element 3 furthermore comprises a hole 8 extending in a direction substantially parallel to the longitudinal direction $d_{Long}$ and protruding on either side of the surfaces of the wall 2 over lengths L that are greater than or equal to the largest dimension of the cross section Sc of the conductive element 3, the cross section Sc of the conductive element 3 being considered level or flush with the wall 2.

In other words, if the cross section Sc of the conductive element 3 is circular and constant within the thickness e of the wall 2, the hole 8 extends on either side of the surfaces of the wall 2 or, in other words, protrudes on either side of the surfaces of the wall 2, over respective lengths that are greater than or equal to the first diameter d1 thus limiting expansionary and compressive mechanical stresses generated by temperature variations during the passage of the energy.

The hole 8 may be located in any position, but advantageously the hole 8 is centered. The hole 8 may be closed or open onto one or other of the ends of the conductive element 3. Preferably, the hole 8 opens onto at least one of the ends of the conductive element 3. The hole 8 may have any cross section St (shown in FIG. 4); preferably the cross section St of the hole 8 is circular and constant within the thickness e of the wall 2, thereby allowing the hole 8 to be formed by drilling. The hole 8 has a second diameter d2.

Advantageously, the ratio of the area of the cross section Sc of the conductive element 3 after the hole 8 has been drilled to the area of the cross section Sc of the conductive element 3 before the hole 8 has been drilled is comprised between 0.85 and 0.95, and is preferably higher than or equal to 0.9.

In other words, the cross section Sc of the conductive element 3 after drilling is larger than 90% of the cross section Sc of the conductive element 3 before drilling. Thus, the loss of effective area allowing energy to be transferred is very small.

Therefore, if the cross section Sc of the conductive element 3 and the cross section St of the hole 8 are circular in the thickness of the wall 2, the ratio of a diameter d2 of the hole 8 to a diameter d1 of the conductive element 3 is then 0.3 at least. The diameter d1 is referred to as the first diameter and the diameter d2 is referred to as the second diameter. The diameter of the drill hole may be the smallest producible, typically 0.2 mm.

Another aspect of the invention includes placing a plurality of high-power energy transmission enabling microwave devices substantially parallel to the longitudinal direction $d_{Long}$. This aspect of the invention is shown in FIG. 3.

Figure 3:
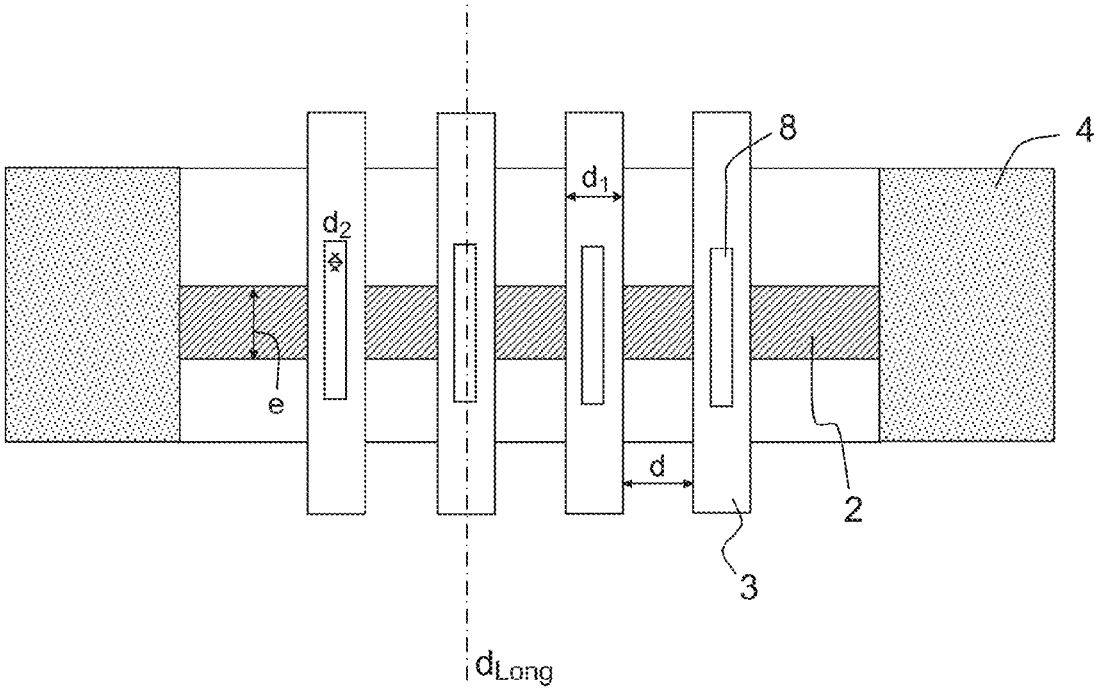
FIG. 3 shows a multiple passage device for passing energy from one medium to another, according to another aspect of the invention.

Advantageously, the distance d, shown in FIG. 3, between two successive devices for transmitting energy is larger than or equal to 0.5 mm. FIG. 3 further illustrates the conductive element 3 having the first diameter D1, the thickness e of the wall 2, the cladding 4 arranged coaxially around the wall 2, and the hole 8 having a second diameter $d_2$.

The invention claimed is:

1. A device for transmitting energy, comprising:

a wall separating two media; and at least one conductive element passing through the wall, the conductive element comprising an energetically conductive material extending in a longitudinal direction;

wherein the at least one conductive element is joined to the wall and includes a hole passing through the wall and extending in a direction substantially parallel to the longitudinal direction on either side of surfaces of the wall over respective lengths that are greater than or equal to a largest dimension of a cross section of the at least one conductive element when the at least one conductive element is flush with the wall, and wherein a maximum ratio of an area of the cross section of the at least one conductive element when the hole is present in the at least one conductive element to an area of the cross section of the at least one conductive element without the hole, when the at least one conductive element is flush with the wall, is higher than or equal to a threshold lying between 0.85 and 0.95.

2. The device for transmitting energy according to claim 1, in which the threshold is higher than 0.9.

3. The device for transmitting energy according to claim 1, in which the cross section of the at least one conductive element lying within a thickness of the wall is circular and has a constant cross section having and a first diameter.

4. The device for transmitting energy according to claim 3, in which the first diameter is smaller than or equal to 3 mm.

5. The device for transmitting energy according to claim 1, in which a cross section of the hole considered flush with the wall is circular and constant.

6. The device for transmitting energy according to claim 1, in which a thickness of the wall in the longitudinal direction is smaller than or equal to 1 mm.

7. The device for transmitting energy according to claim 1, comprising a plurality of conductive elements including the at least one conductive element, each of said plurality of conductive elements arranged substantially parallel to the longitudinal direction, a distance between two successive conductive elements in the plurality of conductive elements being greater than or equal to 0.5 mm.

8. The device for transmitting energy according to claim 1, wherein said device is a microwave window.

* * * * *